US008365807B2

(12) United States Patent
Wagstaff et al.

(10) Patent No.: US 8,365,807 B2
(45) Date of Patent: Feb. 5, 2013

(54) REDUCTION OF BUTT CURL BY PULSED WATER FLOW IN DC CASTING

(75) Inventors: Robert Bruce Wagstaff, Greenacres, WA (US); Mark D. Anderson, Spokane Valley, WA (US); Aaron David Sinden, Valleyford, WA (US)

(73) Assignee: Novelis Inc., Toronto, Ontario (CA)

( * ) Notice: Subject to any disclaimer, the term of this patent is extended or adjusted under 35 U.S.C. 154(b) by 0 days.

(21) Appl. No.: 13/421,350

(22) Filed: Mar. 15, 2012

(65) Prior Publication Data

US 2012/0241118 A1 Sep. 27, 2012

Related U.S. Application Data

(60) Provisional application No. 61/465,708, filed on Mar. 23, 2011.

(51) Int. Cl.
*B22D 11/049* (2006.01)
*B22D 11/124* (2006.01)

(52) U.S. Cl. ..... 164/487; 164/444

(58) Field of Classification Search ..... 164/487, 164/444

See application file for complete search history.

(56) References Cited

U.S. PATENT DOCUMENTS

| | | | |
|---|---|---|---|
| 3,441,079 | A | 4/1969 | Bryson |
| 3,713,479 | A | 1/1973 | Bryson |
| 4,351,384 | A | 9/1982 | Goodrich |
| 5,582,230 | A | 12/1996 | Wagstaff et al. |
| 6,056,041 | A | 5/2000 | Caron et al. |
| 7,007,739 | B2 | 3/2006 | Shaber |
| 2002/0174971 | A1 | 11/2002 | Langlais et al. |

OTHER PUBLICATIONS

Canadian Intellectual Property Office, International Search Report, Apr. 5, 2012, PCT/CA2012/050151 (Novelis Inc. et al.).

*Primary Examiner* — Kuang Lin
(74) *Attorney, Agent, or Firm* — Cooper & Dunham LLP

(57) ABSTRACT

The invention provides a method of reducing butt curl during DC casting of a metal ingot. The ingot is cast in at least two stages, including an initial casting stage and then a steady-state casting stage carried out at higher casting speed. The emerging ingot is cooled by directing a liquid coolant onto its outer surface. During the first casting stage, the liquid coolant is directed in the form of at least two streams, including a constant first stream in the form of a series of first jets, and an intermittent second stream in the form of a series of second jets. The first and second jets impact the outer surface at locations spaced from each other peripherally and/or longitudinally of the ingot. Both the first and second streams experience film boiling when they contact the ingot. The invention includes apparatus for the method.

34 Claims, 8 Drawing Sheets

REDUCTION OF BUTT CURL BY PULSED WATER FLOW IN DC CASTING

CROSS-REFERENCE TO RELATED APPLICATION

This application claims the priority right of prior U.S. provisional Patent Application Ser. No. 61/465,708 filed on Mar. 23, 2011 by applicants named herein. The entire contents of provisional patent application 61/465,708 are specifically incorporated herein by this reference.

BACKGROUND OF THE INVENTION (1) Field of the Invention

This invention relates to casting of metal ingots by direct chill (DC) casting techniques. More particularly, the invention relates to methods of and apparatus for reducing so-called butt curl that occurs in the formation of ingots during DC casting.

(2) Description of the Related Art

DC casting has been used for many years for producing metal ingots, particularly ingots made of aluminum and aluminum-based alloys. Such ingots are then often subjected to hot and cold rolling to produce metal sheet supplied to industry for the fabrication of products or parts thereof. Briefly described, DC casting involves continuously introducing molten metal into a water-cooled vertical-axis mold having the shape of the desired ingot so that the periphery of the metal quickly cools and becomes sufficiently strong to allow an embryonic ingot to be withdrawn from the opposite (lower) end of the mold supported on a descending bottom block that initially closes the lower end of the mold. To provide rapid cooling of the embryonic ingot as it emerges from the lower end of the mold, streams of a liquid coolant (normally water) are contacted with the external surface of the ingot immediately below the mold and the coolant flows down the outer surface of the ingot. A variation of this technique employs a horizontal-axis casting mold, but the procedure is essentially the same.

A problem that has been difficult to overcome in DC casting techniques, particularly when casting rectangular ingots, is so-called butt curl. This is a tendency of the bottom end of the ingot (the part formed first) to adopt a curved profile under the effects of thermal stresses that are produced at the start of casting. Such bowing causes the side and end faces of the ingot to buckle and distort adjacent to the lower end, although the effect is most pronounced on the short end faces of a rectangular ingot. The resulting distortion causes problems during subsequent rolling of the ingot and, to avoid this, the lower end part of the ingot may be cut off and discarded before rolling commences. This is wasteful of material and adds an additional step to the overall process.

Attempts have been made in the past to reduce or eliminate butt curl but without a satisfactory degree of success, U.S. Pat. No. 3,441,079 to Bryson issued Apr. 29, 1969 discloses a method and apparatus for continuously casting aluminum ingots wherein the emergent ingot is subjected to controlled cyclic cooling to decrease the extent of bottom-bow (butt curl) and notch formation.

U.S. Pat. No. 3,713,479 also to Bryson issued Jan. 30, 1973 discloses a method and apparatus for direct chill casting in which the ingot emerging from the mold passes successively through a first cooling zone and a second cooling zone located at a predetermined distance from the first cooling zone along the direction of ingot advance. The purpose of this disclosure is primarily to allow faster casting speeds without causing hot cracking of the ingot.

U.S. Pat. No. 5,582,230 to Wagstaff et al. issued Dec. 10, 1996 discloses a method and apparatus in which two sets of coolant streams are discharged onto an ingot emerging from a direct chill casting mold. The streams are orientated at different angles. One set of the streams is used during the initial stage of casting and both are used in the main casting stage. The use of a single set of streams in the initial stage helps to reduce butt curl.

U.S. patent application publication no. 2002/0174971 A1 of Nov. 28, 2002 discloses a method and apparatus similar to that of Wagstaff et al. but in which the two sets of streams are blended so that a single stream is produced that can be varied in its point of impact with the ingot at different stages of casting to minimize cooling related defects in the ingot.

Despite these prior methods and apparatus improved solutions are desired.

BRIEF SUMMARY OF THE INVENTION

According to one exemplary embodiment of the invention, there is provided a method of reducing butt curl during direct chill casting of a metal ingot. The method involves casting a metal ingot in a direct chill casting mold in at least two casting stages including an initial casting stage carried out at a first casting speed and a steady-state casting stage carried out after the initial stage at a second casting speed higher than the first casting speed. The initial casting stage is, of course, the stage when the cast ingot first emerges from the mold up to a certain length when the rate of advance of the ingot (casting speed) can be increased. The method applies to the initial casting stage and involves advancing the ingot emerging from an exit of the casting mold along a direction of ingot advance, and cooling the ingot by directing a liquid coolant (normally water or water with dissolved additives) onto an outer surface of the emerging ingot. During the initial stage, 1(1 the liquid coolant is directed onto at least a part of the outer surface of the ingot in the form of at least two streams, including a constant first stream directed onto the at least part of the outer surface in the form of a series of first jets, and an intermittent second stream directed onto the at least part of the outer surface in the form of a series of second jets, wherein the first and second jets impact the at least part of the outer surface at locations of IS impact spaced from each other. Further, both the first and second streams of liquid coolant are arranged to have locations of impact and rates of flow effective to permit film boiling to take place within the streams when first in contact with the at least part of the outer surface. The first jets and second jets are preferably approximately the same in number and are preferably equally spaced around the periphery of the ingot.

The mold may be of any desired shape, but is preferably generally rectangular, having two opposed longer faces and two opposed shorter ends, with the streams preferably being directed onto the longer faces and more preferably both the long faces and the shorter ends. The locations of impact of the first and second jets are preferably spaced from each other peripherally around the ingot, with the first and second jets alternating with each other around the ingot. The locations of impact of the first and second jets are also preferably spaced from each other along the ingot in the direction of ingot advance. The positions of impact should preferably not coincide, but may be arranged quite close to each other provided the second streams of coolant, when flowing, increase the area of the ingot surface under coolant relative to the first streams, provided both the first and second streams undergo film boiling when they first contact the ingot. When the locations of impact of the first and second jets are separated from each other in the direction of ingot advance, the streams may be directed in such a way that the constant first jets impact the surface of the ingot at locations further from the mold exit than the intermittent second jets in the direction of ingot advance, or vice versa. In the former case, the locations of impact are preferably spaced from each other by a distance corresponding to up to 10 diameters of the jets, or of the widest of the jets if the diameters of the jets differ from each other. In the latter case, the locations are preferably spaced from each other by a distance corresponding to up to seven diameters of the jets, or of the widest of the jets if diameters of the jets differ from each other, As noted, both the first and second jets make impact with the surface of the ingot where film boiling will occur. This normally requires a surface temperature of about 200° C. or higher, e.g. about 200 to 550° C. The surface temperature is highest where the ingot emerges from the mold exit and cools with distance from the exit in the direction of strip advance. The jets are therefore directed onto a region of the ingot surface close to the mold exit where the temperature is within the desired range. As coolant liquid flows down the ingot (if the ingot is vertical), it encounters regions of lower temperature and nucleate boiling (and eventually no boiling) will take place in such regions. Initial film boiling is desired because cooling of the ingot is somewhat less rapid than nucleate boiling, which provides finer control of temperature desirable for the initial stage of casting to control butt curl.

The jets of coolant liquid are normally directed onto the surface of the ingot at an angle relative to the ingot surface. This angle is generally in the range of 15 to 105° with a component in the direction of ingot advance. The jets of the constant first stream preferably have angles of impact 15 to 30°, and the intermittent jets of the second stream preferably have angles of impact of 30 to 105°. The particularly preferred angles are about 22.5 and 45°, respectively. The first and second streams preferably have average rates of flow in the initial stage of casting of 0.1 to 0.5 gallons per minute per inch of mold bore (the mold bore is the periphery of the mold, often considered to be the periphery of the casting surface within the mold). The intermittent second stream is preferably caused to flow for a time period of 5 to 20 seconds (more preferably 5 to 15 seconds), and is then caused to stop for a time period of 10 to 25 seconds (more preferably 15 to 20 seconds), with the time periods being repeated sequentially until the initial casting stage ends. The on/off periods of these jets is determined either empirically or by means of calculation or modeling to produce a rate of ingot cooling in the initial stage optimized for reduction of butt curl with minimal additional undesirable cooling artifacts, and is generally controlled automatically by means of a numeric calculator (such as a programmable logic controller or a computer).

In the initial stage of casting, the coolant is preferably first directed onto the outer surface when the emerging ingot has a length of about 50 mm from the exit of the mold in the direction of ingot advance and is terminated when the emerging ingot has a length of about 200 mm (more preferably 150 mm) from the exit of the mold in the direction of ingot advance corresponding to an end of the initial casting stage. There may be no application of coolant liquid before 50 mm of the ingot has emerged because this part of the ingot may be shielded by the bottom block as it emerges from a position closing the mold exit. The initial stage of casting is ended when the ingot has a length considered suitable for regular steady state liquid cooling without risk of causing undesirable cooling artifacts to the ingot.

When the coolant streams are provided to the mold from a common source, the flow of coolant liquid to the casting mold is preferably increased when the jets of the second stream are flowing compared to when the jets of the second stream are not flowing so that a rate of flow of the jets of the first stream remains substantially unchanged regardless of whether the jets of the second stream are flowing or not. This may not be necessary when the coolant streams are separate from eachother within the mold and are supplied from separate sources.

Following the initial stage of casting, at least two constant streams of the coolant liquid may be directed onto the outer surface of the ingot during the steady state casting stage, with least one (and preferably both) of the constant coolant streams having a higher rate of flow than each of the constant first stream and the intermittent second stream of the initial casting stage. Moreover, the initial casting stage and the steady state casting stage may be separated in time by an acceleration casting stage in which the speed of advance of the ingot is increased in rate from the first casting speed to the second casting speed. At least two constant streams of the liquid coolant are preferably directed to the outer surface of the ingot during the acceleration casting stage and at least one of the two streams (preferably both) is increased in rate of flow as the acceleration casting stage proceeds.

A further exemplary embodiment of the invention provides apparatus for direct chill casting a metal ingot, the apparatus having a mold having an inlet for molten metal, an exit for an ingot cast in the mold, a casting surface between the inlet and the exit, and a jacket for coolant liquid surrounding the casting surface. Holes are provided in the jacket surrounding the exit for directing at least two streams of coolant liquid onto at least part of an outer surface of the cast ingot as the ingot emerges from the exit, including first stream in the form of a series of first jets of coolant liquid and a second stream in the form of a series of second jets of coolant liquid. The first and second jets impact the at least part of the outer surface at locations of impact spaced from each other. First passageways supply coolant liquid to the holes for the first stream and second passageways supply the holes for the second stream. At least one valve member is provided having a first position interrupting flow of coolant liquid only through the second passageways, and a second position permitting flow of coolant liquid through the second passageways. A valve operator is capable of moving the valve member between the first position and the second position, and a control unit provides commands for operation of the valve operator and is adapted to cause the valve member to move repeatedly between the first and second positions during an initial stage of casting to cause the second stream of coolant liquid to flow intermittently during the initial stage of casting while the first stream flows constantly during the initial stage of casting.

The valve member is preferably located within the mold in a passage between two chambers, a first chamber connected to the first passageways and a second chamber connected to the second passageways. The valve operator may comprises a housing defining an interior volume, a movable element in the interior volume operatively attached to the valve member, a flexible gas bellows attached between the movable element and an internal surface of the housing to separate the internal volume into two parts, one part being remote from the valve member and another part being proximate the valve member, and a bore in the housing allowing entry of gas into or removal of gas from the one part of the internal volume remote from said valve member. Excess gas pressure within the one remote part causes the movable member to move the valve member to the first position, and release of the excess gas pressure allows the valve member to move to the second position under pressure of coolant liquid in said first chamber.

Alternatively, the first and second passageways for coolant liquid may remain unconnected within the mold, in which case the valve member may be located in the second passageways outside the mold.

The apparatus may include means for varying the rate of advance of the ingot, whereby the mold is operated at a first rate of advance during the initial stage of casting, and at a second rate of advance during a later steady state stage of casting, the control unit being adapted to provide the commands to move the valve member between the first and second positions only during the initial stage of casting.

The exemplary embodiments of the invention may be used for producing ingots from any metals that may be cast by DC casting techniques, but it is particularly preferred for casting ingots of aluminum or aluminum-based alloys. The exemplary embodiments may also be employed with both vertical and horizontal DC casting apparatus, and may be arranged for casting either monolithic metal ingots or composite ingots made of two or more distinct metal layers. The exemplary embodiments may be employed for horizontal direct chill casting as well as vertical direct chill casting.

As noted above, an objective of the exemplary embodiments is to create film boiling when the jets of coolant liquid contact the ingot surface in the initial stage of casting. During film boiling there is a buildup of bubbles of vapor that throws the remainder of the coolant off the ingot surface, although the coolant (or some of it) may contact the ingot surface lower down the ingot surface where temperatures are cooler. The buildup of vapor happens so quickly that it is perceived as instantaneous. The occurrence of film boiling is therefore apparent from visual inspection. During the initial stage of casting in production facilities operating vertical direct chill casting molds, the ability to see clearly under a casting table (apparatus holding one or more casting molds) may be limited and the points of contact of the jets with the ingot surface may not be visible. However, film boiling is apparent from falling coolant that has been thrown off the ingot surface above the highest viewing point. In such circumstances, there is usually an observable gap between the starting block of the mold and the falling coolant thrown off from the ingot. In contrast, nucleate boiling, which is to be avoided in this stage of the casting operation and may occur at higher volumes and/or pressures of coolant flow, the coolant stays in contact with the ingot surface all the way down the ingot to the bottom block. There is then no observable gap between the coolant liquid and the ingot surface above the bottom block. For horizontal casting, similar signs of film boiling are apparent.

BRIEF DESCRIPTION OF THE SEVERAL VIEWS OF THE DRAWINGS

Exemplary embodiments of the invention are described in detail in the following with reference to the accompanying drawings, in which:

FIGS. 6A and 6B are side views of part of an outer surface of an ingot showing, in mid-stream vertical cross-section, jets of liquid coolant as they impinge on the ingot surface, wherein FIG. 6A shows the view when the intermittent coolant stream is off and FIG. 6B shows the view when the intermittent coolant stream is in flow;

DETAILED DESCRIPTION

Figure 1:
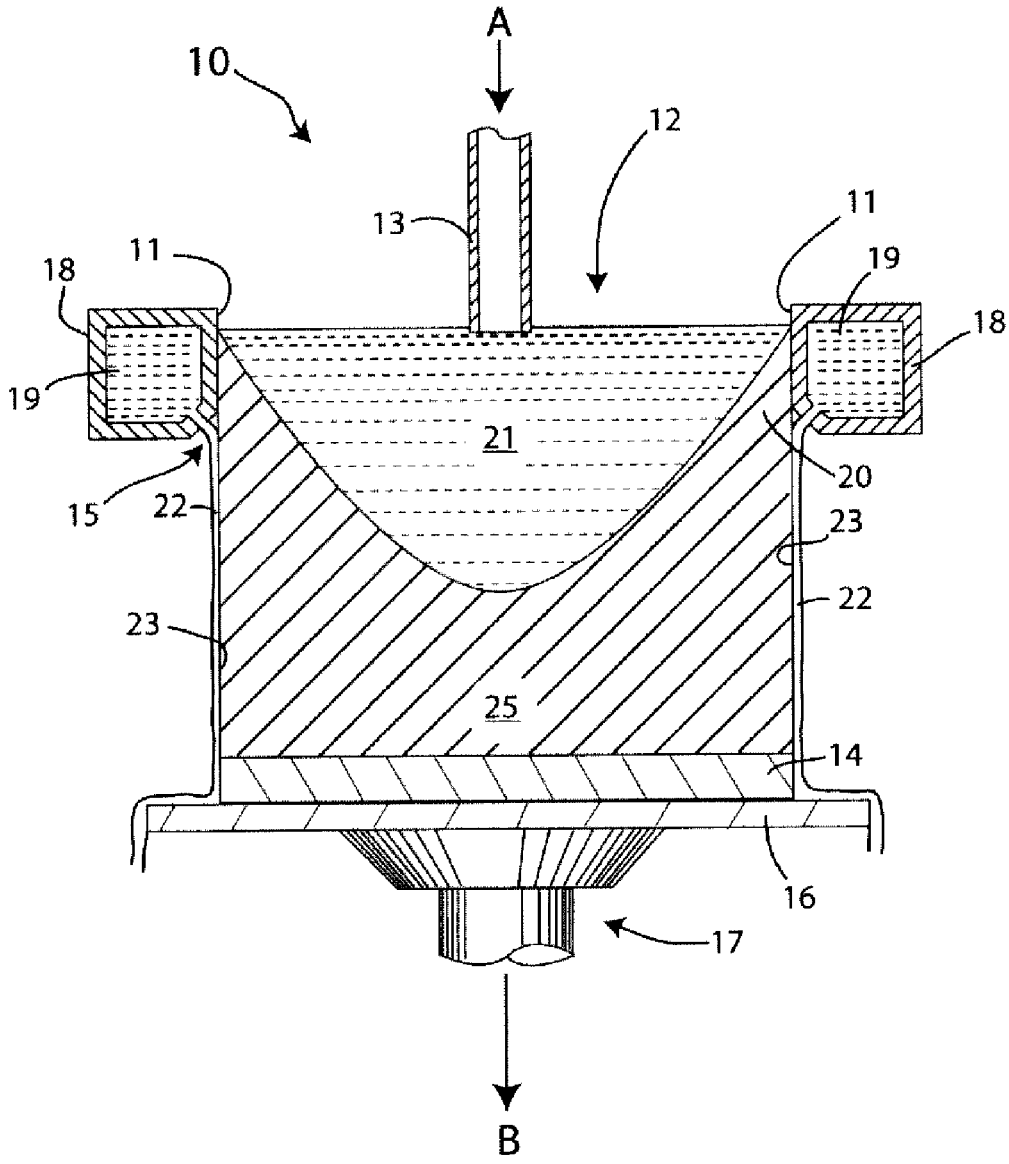
FIG. 1 is a vertical cross-section of a direct chill casting mold used for casting a monolithic metal ingot.

FIG. 1 of the accompanying drawings shows a simplified form of a direct chill casting apparatus 10 in vertical mid-plane cross-section. The apparatus has a vertically-orientated direct chill casting mold 11 encircling a casting cavity 12 into which molten metal, represented by arrow A, is introduced via a spout 13 supplied with molten metal from a suitable source (not shown), e.g. a metal melting furnace. The mold 11 is generally rectangular in plan view, but may alternatively be of any desired shape, including circular. At the start of casting, a bottom block 14 is positioned within an exit 15 of the casting mold so that it temporarily closes the mold exit to allow a body of metal to build up within the casting cavity 12. As casting proceeds, the bottom block 14 is gradually lowered, as represented by arrow B, so that a cast ingot 25 gradually emerges from the mold exit 15 and continually grows in length until the casting operation is terminated. The bottom block 14 is itself supported on a platen 16 of a hydraulic ram device 17 (shown in part) that supports the growing ingot and controls the rate of descent of the bottom block and hence the casting speed.

The mold 11 is cooled or chilled by a surrounding coolant jacket 18 that holds a coolant liquid 19, normally water or water containing dissolved additives such as anti-freeze chemicals, so that the periphery of the molten metal starts to cool and solidify as it contacts the internal casting surface formed by the inner walls of the mold 11 to form a solid outer shell 20. The cooling provided by the jacket 18 is referred to as primary cooling. As shown in the drawing, a central core of the emerging ingot may remain liquid to form a liquid sump 21, but eventually the ingot becomes solid throughout as it descends further and cools sufficiently. The cooling of the shell 20 is further assisted by streams 22 of coolant liquid that are poured onto an outer surface 23 of the emerging ingot from the jacket 18 through holes provided around the mold adjacent to the exit 15 of the mold. The coolant liquid streams flow down over the outer surface 23 of the mold and remove heat from the outer surface. This is referred to as secondary cooling.

The casting procedure is normally divided into a number of stages. In an initial casting stage at the start of the casting operation, the bottom block 14 is lowered at a relatively slow rate (normally in the range of 25 to 75 mm/min, depending on the alloy being cast) and the rate of flow of the streams 22 of coolant liquid may be slowed (compared to later stages of casting) to avoid overly rapid cooling of the emerging ingot. After the initial stage, when the lower end or butt of the ingot has properly formed, there is normally an acceleration (ramp-up) stage during which the speed of casting is continually increased and the streams 22 of coolant liquid are increased in rate of flow. Finally, there is a steady-state casting stage in which the casting speed is held constant (normally at a speed in the range of 40 to 80 mm/min, depending on the alloy being cast) and the rate of flow of the streams 22 is held at a maximum rate of flow until the end of the casting operation.

Figure 2:
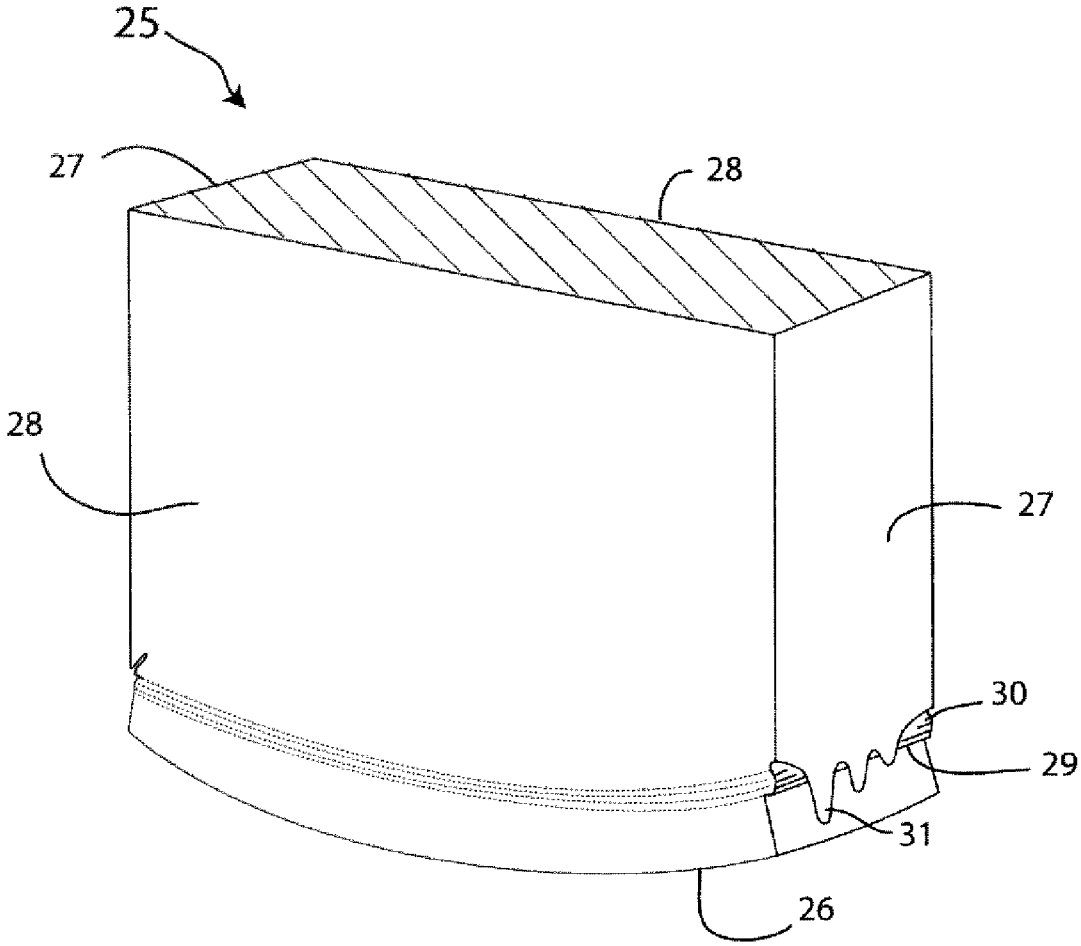
FIG. 2 is a perspective view of a bottom part of a metal ingot cast in a conventional manner illustrating the formation of defects known as butt curl, cold shuts and icicles.

The indicated conditions in the initial stage of casting are normally provided to ensure a proper start of ingot casting and to minimize the formation of butt curl at the lower end (the end first formed) of the ingot. Butt curl in a rectangular ingot is illustrated schematically in FIG. 2. Thermal stresses in the newly forming ingot 25 tend to cause the bottom surface 26 of the ingot to adopt a curve from the center upwardly towards the side edges. This curve forms in both the side-to-side direction (i.e. between the narrow end faces 27 of the ingot) as well as in the front-to-back direction (between the large side faces 28) of the ingot, but the curve is most pronounced in the side-to-side direction and tends to cause the bottom ends of the narrow end faces 27 to extend beyond the confines of the remainder of these faces, and to form a pronounced crease 29 near the lower end of the ingot. This distortion of the side surface may cause molten metal to escape temporarily from the mold and run over the side faces of the ingot, thus forming so-called cold shuts 30 and/or icicles 31. As previously explained, this is undesirable because such phenomena create problems during hot and cold rolling of the cast ingot in the subsequent formation of sheet articles. Sometimes, the lower portion of the ingot is cut off prior to rolling to avoid such problems, but this is wasteful of cast metal and otherwise uneconomical.

As noted above, attempts are usually made to minimize butt curl by slowing the casting speed during the initial stage of casting and controlling the streams of coolant liquid used for secondary ingot cooling. However, it is difficult to achieve optimal conditions of casting speed and coolant liquid flow. In the past, secondary coolant liquid flow rate and casting speed were the only things that could be modified in normal practice, and they had to be modified together (an increase in speed necessitated an increase in coolant flow, and vice-versa). It is theorized that secondary ingot cooling in the initial stage of casting should be minimized to avoid the creation of thermal stresses in the ingot as the metal cools. However, if there is too little secondary cooling, the shell of the ingot remains thin and may collapse or crack. On the other hand, if the secondary cooling is too rapid, butt curl may be pronounced and the ingot may undergo longitudinal cracking later during the casting operation. The situation is further complicated by the way in which the coolant liquid cools the ingot. When the coolant liquid is water (which is normal), the water tends to vaporize on first contact with the hot ingot surface and the vapor forms an insulating film or layer between the ingot surface and the bulk of the liquid water. This is referred to as "film boiling" and the amount of heat extracted by the water is minimized because of the presence of the intervening vapor layer. The occurrence of film boiling depends on several factors, but the main factors are the temperature of the ingot surface, the rate or pressure of flow of the water poured onto the surface and, to a lesser degree, the angle of impact of the cooling water with the ingot surface. If the surface is relatively cool (e.g. below about 200° C.), the rate of boiling is slow enough that the intervening vapor film does not form or quickly collapses so that liquid may directly contact the surface. Instead, bubbles form from specific locations on the surface. This is referred to as "nucleate boiling" and the direct contact of liquid with the surface causes a rapid extraction of heat. The division between film boiling and nucleate boiling takes place at a temperature referred to as the Leidenfrost point. The rate of flow of secondary cooling water can also affect film boiling by causing turbulence within the liquid stream that causes the insulating film of vapor to collapse momentarily so that liquid contacts the surface temporarily. When the flow of cooling water is low, such turbulence is not created or is not sufficient to interfere with film boiling. At and beyond a certain rate of flow, the momentum of the water streams causes sufficient turbulence to increase the rate of heat transfer from the surface. Also, variation of the angle of impact of the cooling water can affect turbulence in the liquid stream, especially when the flow rate is high. For any given rate of flow, oblique angles create the least turbulence, whereas angles approaching 90° to the surface are more likely to increase the degree of turbulence and hence to reduce the effects of film boiling.

In the film boiling regime, until sufficient turbulence is created, the rate of heat extraction is not affected greatly by variations of the rate of flow of the cooling water because, as the rate of flow is increased, the extra water is held away from the hot ingot surface by the vapor film, so the additional flow of water does not contribute significantly to the conduction of heat. The rate of heat transfer is therefore governed more by the rate of heat conduction through the vapor film than conduction through liquid water. However, as already noted, if the rate of flow goes beyond a critical amount, or if the surface temperature of the ingot falls sufficiently, heat is suddenly removed from the surface in larger amounts due to the formation of nucleate boiling. Typically, therefore, there is no gradual variation of the rate of heat extraction as the cooling transitions from film boiling to nucleate boiling.

To minimize butt curl, it has been proposed to control the secondary cooling during the initial casting stage to ensure that film boiling occurs, at least in a region surrounding the initial point of impact of the coolant streams with the emerging ingot. This ensures that the rate of cooling in the hottest region of the ingot newly emerging from the exit of the mold is minimized to avoid the creation of undue thermal stresses. Nevertheless, the rate of cooling may be too low for the formation of an appropriate shell thickness, or too high for the minimization of thermal stresses, and as noted there is little ability for fine control over the rate of heat extraction actually achieved during the film boiling regime. It is therefore the purpose of exemplary embodiments of this invention to achieve more control over the rate of heat extraction that can be achieved during the initial stage of casting.

U.S. Pat. No. 5,582,230 to Wagstaff et al. (the disclosure of which is fully incorporated herein by this reference) discloses a direct chill casting mold in which the water jacket is divided into two internal chambers, one of which supplies cooling water to first set of passageways leading to a first set of holes spaced circumferentially around the mold exit and the other of which supplies cooling water to a second set of passageways leading to second set of holes also spaced around the mold exit and staggered (interspersed) with respect to the first set. One of the sets of passageways is oriented downwards at an angle of 22.5° to the vertical axis of the mold and the other of which is orientated downwards at an angle of 45°. The 22.5° passageways are used during the initial casting stage with a relatively slow rate of flow of cooling water to ensure that cooling with film boiling occurs in the region of impact to thereby minimize butt curl. Then, during the steady-state stage of casting, both sets of passageways are employed with higher rates of water flow to create high rates of heat extraction by generating turbulence at the ingot surface and consequent nucleate boiling. Apparatus of the kind shown in this prior reference may be employed with important modifications for operation according to exemplary embodiments of the present invention. Of course, other kinds of apparatus may also be employed if the same desired effects are achieved, so the exemplary embodiments are not limited to apparatus of the kind disclosed by Wagstaff et al.

Figure 3:
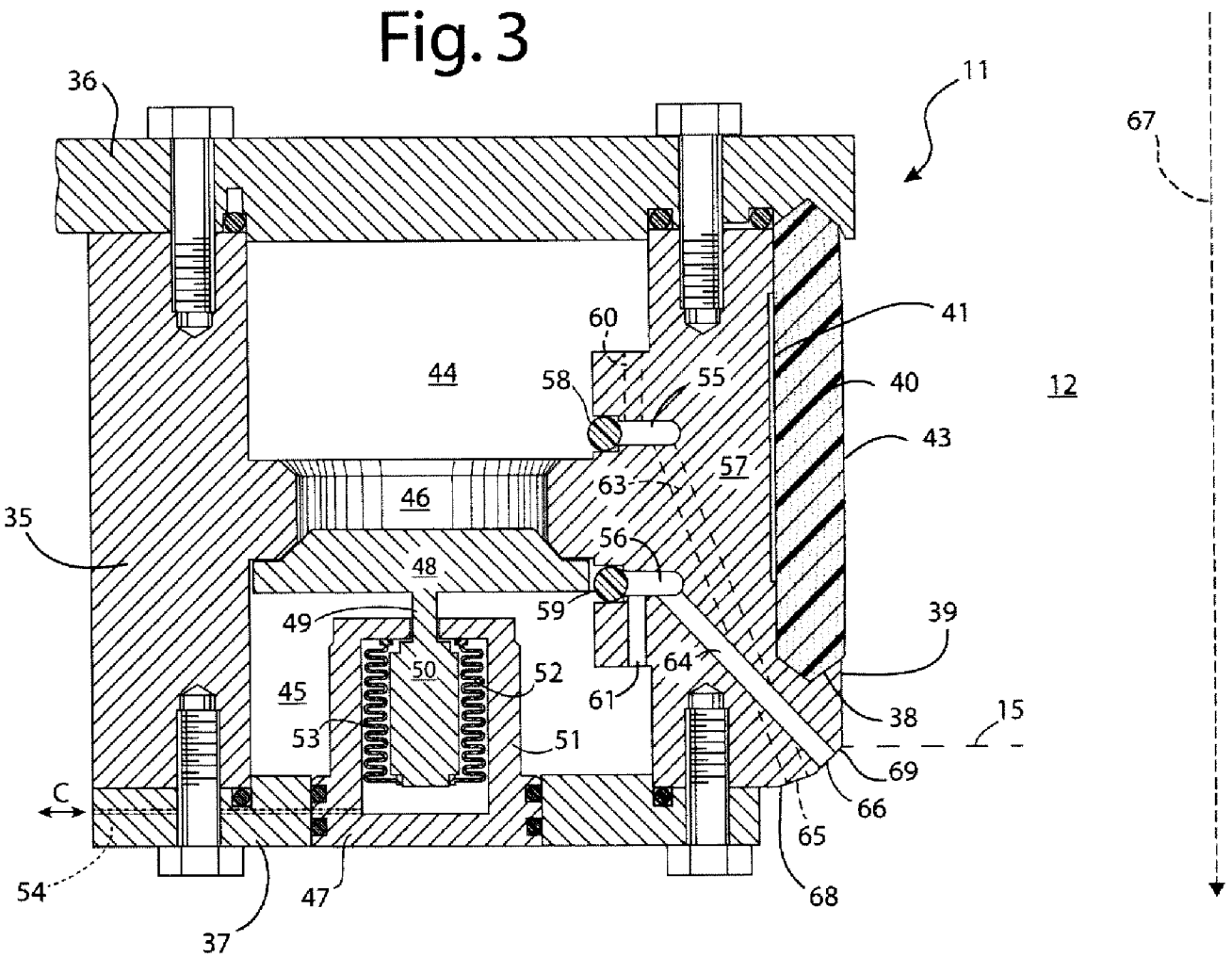
FIG. 3 is a vertical cross-section of on part of a vertically-oriented direct chill casting mold having two internal chambers and providing two sets of holes for delivering liquid coolant onto an ingot surface with a valve used to control flow of liquid coolant from the chambers through the holes.
Figure 4:
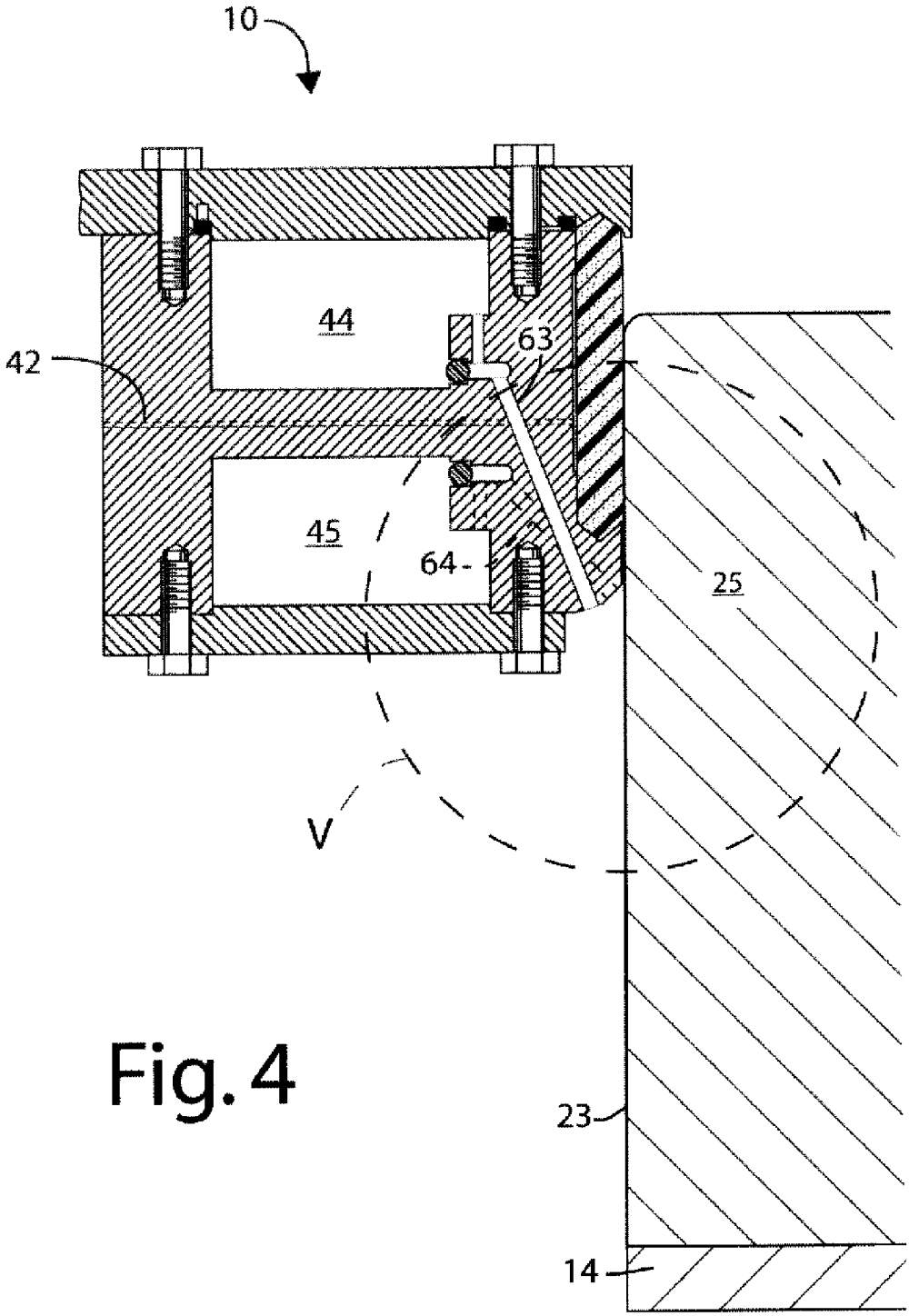
FIG. 4 is a vertical cross-section similar to FIG. 3 but on a smaller scale showing another part of the mold spaced from the valve and showing parts of an adjacent metal ingot as it is cast.
Figure 5:
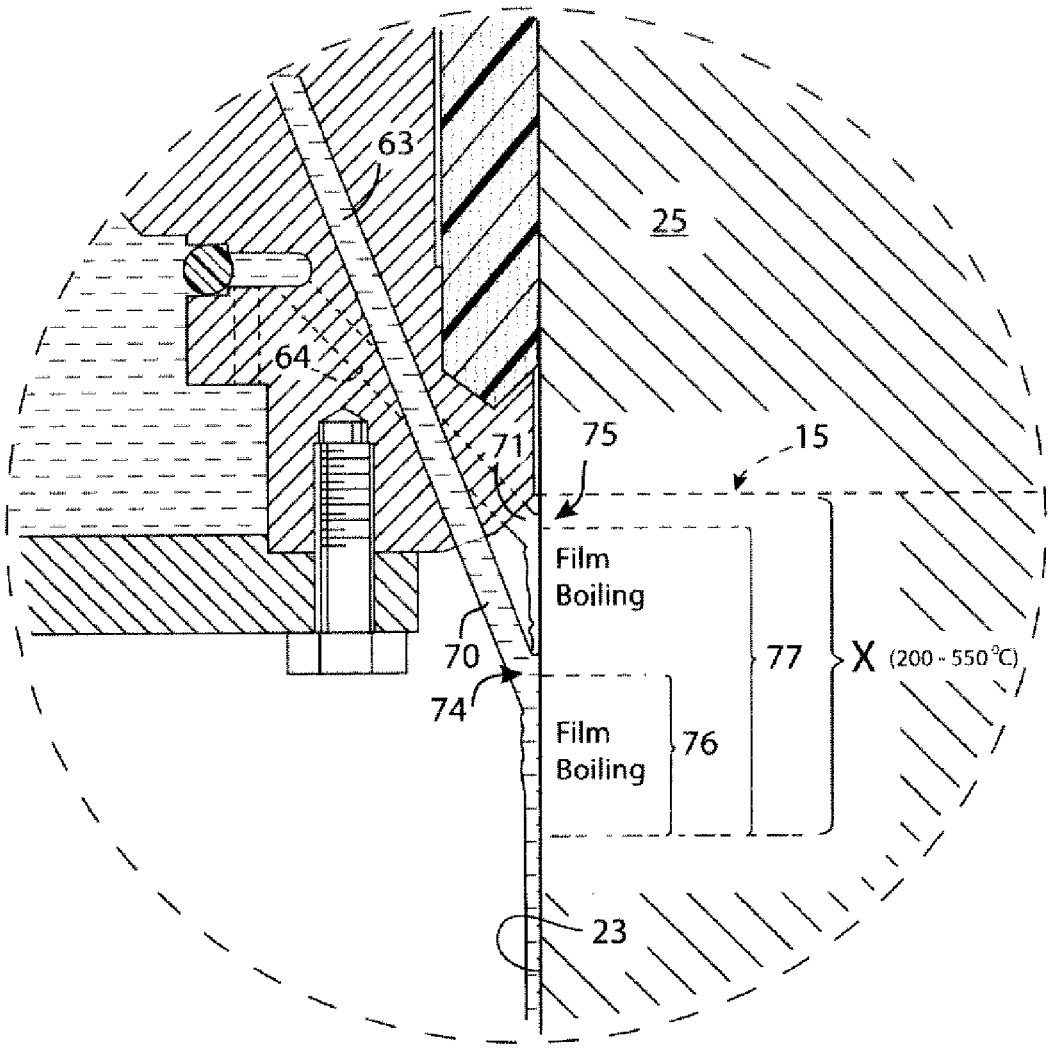
FIG. 5 shows the part of the drawing of FIG. 4 within the broken circle "V", also showing flows of coolant liquid impacting an emerging ingot.

FIG. 3 of the accompanying drawings shows a vertical cross-section of one side of a casting mold and associated cooling jacket which may be operated according to exemplary embodiments of the invention. This view is a cross-section through one side of the mold at a position where a valve device is provided, as will be explained. FIG. 4 is a similar cross-section on a smaller scale but at a different position around the mold where there is no such valve device, and FIG. 5 is an enlargement of part of the apparatus of FIG. 4 (the part in the dashed circle marked V in FIG. 4) showing flows of coolant liquid.

Referring to FIG. 3, mold 11 is formed by a framework 35 to which are bolted an upper plate 36 and a lower plate 37 with appropriate provision of water-tight seals therebetween. The framework 35 has a recess 38 at the inner surface 39 thereof (this is regarded as the inner surface as it confronts the casting cavity 12). An insert 40, preferably made of graphite, is positioned in the recess 38 and forms the casting surface 43 within the mold. The insert is porous so that a gas or lubricant may be permeated through the insert from an encircling chamber 41 formed between the recess 38 and the insert 40 fed with the gas or lubricant under pressure through a supply bore 42 (FIG. 4). The upper and lower plates 36, 37 define two coolant liquid chambers with the framework 35, i.e. an upper chamber 44 and a lower chamber 45. These chambers are joined at just one position around the casting mold, i.e. the position shown in FIG. 3, by a vertical passageway 46. Coolant liquid is supplied under pressure to only one of these chambers, namely upper chamber 44, via external supply tubes (not shown in FIG. 3). A valve device 47 is mounted in a hole in lower plate 37 and is secured against movement by means not shown. The valve device provides a valve element 48 mounted on a valve stem 49 extending into the lower chamber 45. As shown, the valve element 48 is shaped so that it may seat precisely at the lower end of the passageway 46 to block flow of liquid through the passageway from the upper chamber 44 to the lower chamber 45. However, the valve element 48 may be lowered from the seating position when desired to allow flow of liquid between the chambers 44 and 45. The movement of the valve element 48 is controlled by a valve operator forming part of the valve device 47 and comprising a housing 51 encircling a plunger 50 positioned at the base of the valve stem 49 and acting as a movable element within the housing 51. The valve stem may be screwed into a threaded recess (not shown) in the plunger for ease of assembly. The plunger 50 is positioned within an interior volume defined within the housing and is connected at its lower end to the lower end of a cylindrical gas bellows 52 made of a flexible preferably elastomeric material and provided with accordion-type pleats 53. At its upper end, the gas bellows 52 is connected to an internal surface of the housing 51. The gas bellows 52 is sealed against gas and liquid leakage where it is connected to the plunger and to the internal surface of the housing and it (as well as the base of the plunger 50) separates the internal volume of the housing into two parts, one remote from the movable valve element 48 and one proximate to it. The part of the internal volume of the housing 51 remote from the valve element 48 (outside the bellows 52) communicates with a bore 54 which may be supplied with gas under pressure or may be vented to atmosphere as represented by double-headed arrow C. The part of the internal volume proximate the valve element 48 communicates with the chamber 45 and is normally filled with coolant liquid from the chamber. The flexible bellows 52 acts as a diaphragm that separates and seals the variable pressure side of the housing from the side leading to the valve stem 49 and valve element 48, and that accommodates vertical movements of the plunger 50. Although not shown in FIG. 3, in practice, the gas bore 54 is connected at its outer end to a tube communicating with a supply of gas under pressure controlled by a valve (see FIG. 7). When required, the gas under pressure is introduced into the housing 51 through the bore and this forces the plunger 50 to move upwardly and drive the valve stem 49 and valve element 48 upwardly so that the valve element seats within the passageway 46, as shown, and prevents the flow of coolant water from the upper chamber 44 to the lower chamber 45. When the gas under pressure in the housing 51 is released (vented via the valve not shown), excess coolant water pressure in the upper chamber 44 pushes the valve element 48 downwardly so that coolant water may flow from the upper chamber 44 to the lower chamber 45. This downward movement may be assisted by elastic force from the bellows 52 previously generated by extension of the bellows when the plunger 50 is moved upwardly by the gas pressure to close the channel 46.

In the illustrated embodiment, an upper slot 55 and a lower slot 56 extend into the inner side wall 57 of the framework 35 from within the chamber 44 and the chamber 45, respectively. The entrances of these slots are sealed by flexible O-rings 58 and 59. However, one or more holes 60 and 61 connect the regions of the slots behind the O-rings to the chambers 44 and 45, respectively. In turn, these regions are connected to a series of passageways 63 and 64 passing through the framework 35 to the exterior of the mold immediately below the exit 15 of the casting cavity 12. Passageways 63 lead downwardly to external holes 65 and passageways 64 lead downwardly to external holes 66. Passageways 63 are arranged at an angle of 22.5° to the direction of ingot advance 67 through the mold (and thus to the mold axis), and passageways 64 are arranged at an angle of 45° to the direction 67. As will be appreciated from FIG. 3, the passageways and respective holes are staggered (i.e. they alternate) with respect to each other around the mold. Holes 65 open at a surface 68 and holes 66 open at a surface 69, the surfaces being oriented to the mold axis at angles that cause the passageways 63 and 64 to extend at right angles to their respective surfaces 68 or 69.

During operation of the apparatus, liquid coolant under pressure is supplied to the upper chamber 44 from an exterior source through tubes or passageways (not shown in FIG. 3) controlled by appropriate valves (not shown). The 22.5° passageways 63 are connected to the upper chamber 44, so they are always supplied with liquid coolant under pressure when the chamber 44 is itself so supplied. The 45° passageways 64 are connected to the lower chamber 45 which is not itself supplied with coolant liquid from the exterior, and these passageways are thus supplied with coolant liquid under pressure only when the valve element 48 is lowered from the position shown in FIG. 3. The valve device 47 may be under the control of a human operator, but is more usually under the control of a numeric calculator such as programmable logic controller or computer (or other automatic governor), to open and close the valve element 48 according to a schedule (or "recipe") during the various stages of casting, as explained below.

While the valve device 47 has been shown positioned within the lower chamber 45, it could alternatively be located in the upper chamber 44 in an inverted orientation so that the valve element blocks the upper end of passageway 46 when moved to a lowermost position, and is moved by excess water pressure from lower chamber 45 to an upper position allowing flow of coolant liquid through the channel 46. This would require the supply of coolant liquid to be connected to the lower chamber 45 rather than the upper chamber 44 and would, in the apparatus of FIG. 3, make the 45° passageways 64 continuously operated and the 22.5° passageways 63 intermittently operated. However, a valve device in which the valve element is positively moved in both directions (e.g. a spring-loaded valve device operated pneumatically as in U.S. Pat. No. 5,582,230) may be provided in either chamber 44 or 45 regardless of which chamber is supplied with the liquid coolant under pressure because such a valve device does not rely on excess pressure of coolant liquid to move the valve element to the open position.

Figure 6A:
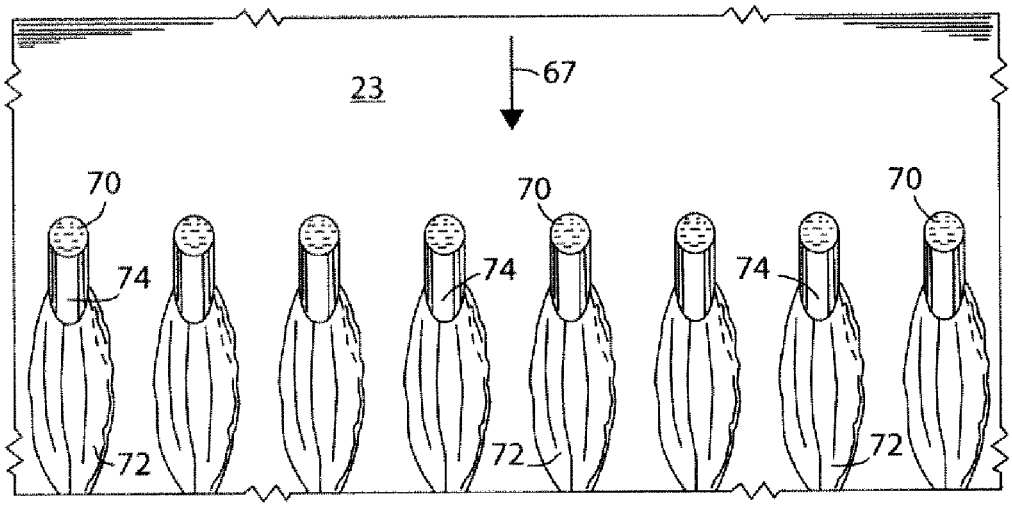
Figure 6B:
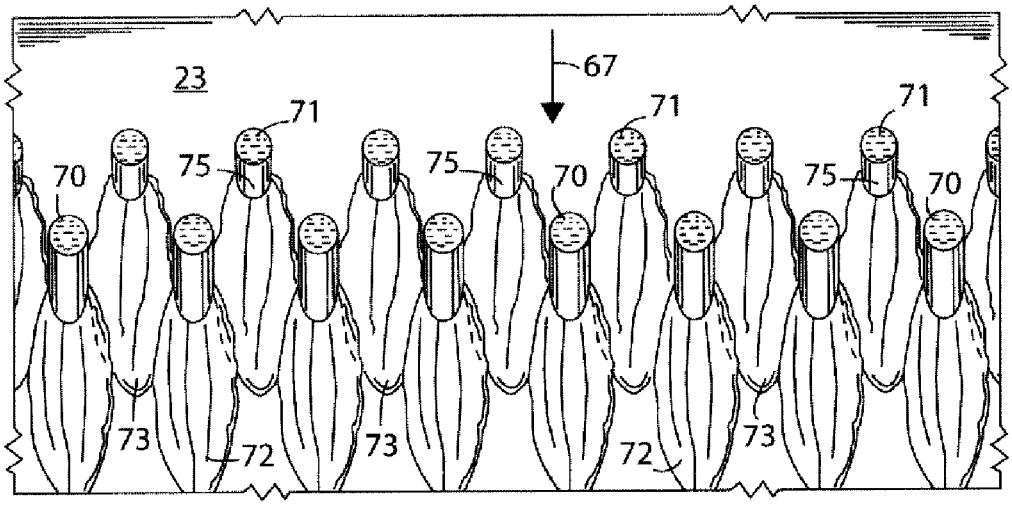

Referring to FIGS. 4 and 5, during the initial stage of casting, streams of coolant liquid are continuously directed on to the outer surface 23 of an emerging ingot 25 from the 22.5° passageways 63. These streams form jets 70 (FIGS. 5 and 6A) of coolant liquid that impact the ingot surface at impact points 74 around the periphery of the ingot. These jets are "always on" during the initial stage of casting and they are positioned and angled (at 22.5°) to impact the ingot in a region X below the mold exit 15 where the temperature of the ingot surface lies in a film boiling range, normally 200 to 550° C. The angle and rate of flow of the coolant liquid in these jets allows the coolant liquid to form a film boiling region 76 within the coolant liquid on the ingot surface below the point of impact 74. As the coolant flows further down the ingot, any part that remains in contact with the surface 23 may take on nucleate boiling when it encounters temperatures below the range X and, eventually, undergoes little or no boiling as it encounters ever cooler regions of the ingot surface at increasing distances from the mold exit 15. This arrangement provides a relative slow rate of cooling of the ingot surface in the hot region immediately below the mold exit and, for the reasons explained above, this helps to reduce butt curl. However, in order to provide additional cooling, but still within the film boiling regime, the 45° passageways 64 are supplied with coolant liquid intermittently during the initial casting stage. This is achieved by moving the valve element 48 downwardly for short periods of time, and then restoring the valve to the upper closed position. When the valve element 47 is in a downward (open) position, coolant liquid under pressure forms jets 71 which impact the outer surface 23 of the ingot at impact points 75 closer to the mold exit 15 than the impact points 74 of the 22.5° jets 70 (see FIGS. 5 and 6B). The impact points 75 also lie in a region of the outer surface of the ingot having temperatures in the film boiling range, and the rate of flow of the coolant liquid is made such that film boiling is allowed to occur in the region 77 below the point of impact 75. Therefore, when both sets of jets 70 and 71 are operating, as shown in FIGS. 5 and 6B, there are essentially two regions of film boiling 76 and 77 at different positions along the outer surface of the ingot from the mold exit 15 in the direction of advance of the emerging ingot. This means that a greater surface area of the ingot is subjected to cooling with film boiling, and so more cooling takes place, but still within the film boiling regime. This allows for "fine control" of the cooling of this stage of the casting without causing immediate nucleate boiling or thermal shock resulting from turbulence that would cause rapid and unpredictable cooling. By adjusting the rate of cycling or pulsating of the 45° jets 71 (i.e. the time "on" relative to the time "off"), more or less additional cooling from these jets can be provided to suit the ingot undergoing casting and the initial casting speed. The temporary increase of area subject to film boiling causes a further reduction of the surface temperature of the ingot, and hence an increase in the thickness of the solid shell 20 surrounding the metal sump of the embryonic (not yet fully solid) ingot. In this way, cooling of the ingot to avoid over- or under-cooling during the initial stage of casting can be achieved and butt curl can be minimized or virtually eliminated without causing associated problems of ingot failure or cracking. The appropriate extent of such cooling to avoid such problems, and therefore the duration of the pulses of the intermittent streams for each metal, ingot size and each set of casting conditions can be determined empirically from observation and measurement, or according to software developed for modeling casting conditions virtually. The cooling from the 22.5° jets 70 is preferably arranged to be somewhat less than that estimated for proper control of butt curl, so that cooling "top ups" from the 45° jets 71 can be provided as required.

The holes 65 for the 22.5° jets 70 may be positioned so close together around the mold that the jets merge substantially as they impact the ingot to form a continuous sleeve of cooling liquid around the periphery of the ingot, in which case the cooling liquid from the intermittent 45° jets 71 merges with that from the 22.5° jets as the liquid flows down around the ingot surface. Preferably, however, the rates of flow of the coolant liquid jets are low enough to avoid the formation of "interaction fountains" or "corollas" where the jets converge (as mentioned in the Wagstaff patent identified above). Alternatively, as shown in FIG. 6A, the 22.5° jets 70 may be spaced more widely so that coolant liquid from the jets does not fully merge together and individual rivulets 72 flow down the outer surface 23 of the ingot. In this case, when intermittent jets 71 are flowing (shown in FIG. 6B) individual rivulets 73 from jets 71 "fill in the gaps" between the rivulets 72 as the cooling liquid from these jets flows down the ingot surface, so that an essentially continuous sleeve of coolant liquid is then formed around the periphery of the mold only when the jets 71 are in operation. In the latter case, the additional cooling from the jets 71 may be somewhat more pronounced than the additional cooling from the jets 71 obtained in the former case, so this is preferred in some cases. This is because the extra area of cooling produced by the jets 71 in the former case (continuous sleeve of coolant liquid) ends when the cooling liquid rivulets 73 from the jets 71 encounters the cooling liquid from the jets 70. In the latter case (individual rivulets), there may be no such encounter as the coolant rivulets 73 from jets 71 pass between the coolant rivulets 72 from jets 70 with only peripheral merging. In practice, this means that the area of the ingot surface undergoing cooling roughly doubles when the jets 71 are on, compared to when they are off, so the cooling rate also roughly doubles. The arrangement employed in any particular case will depend on the extra cooling effect desired.

In the embodiment shown in FIG. 6B, the jets 70 impact the ingot below the jets 71 in the direction of ingot advance 67, i.e. further from the mold exit. However, in embodiments where impacting rivulets of coolant liquid from the jets 70 do not merge together to form a continuous sleeve around the ingot, the jets 70 and 71 may if desired be made to impact the ingot surface at essentially the same distance from the mold exit. This is because the jets 71 impinge between the jets 70 and the area of coolant liquid contact is thereby increased to create additional cooling. However, it is normally preferred to arrange for the points of impact of the jets 70 and 71 to be separated from each other by a certain distance in the direction of ingot advance from the mold. This separation of the points of impact in the direction of advance of the ingot may be chosen as required for optimal effect. Preferably, the separation of the points of impact is equivalent to up to 10 diameters of the holes from which the jets emerge (if the holes for the jets 70 differ in diameter from the holes for the jets 71, which is possible, then the larger hole diameters are relevant to the preferred spacing of up to 10 hole diameters).

In the embodiment of FIG. 6B, the continuous jets 70 impinge on the ingot surface 23 below the intermittent jets 71 (i.e. further along the ingot in the direction of ingot advance). In alternative embodiments, however, the intermittent jets may impact below the continuous jets. In such cases, the points of impact of the intermittent jets may preferably be spaced below the points of impact of the continuous jets by a distance equivalent to up to seven hole diameters (or seven diameters of the larger holes if the holes for the two jet types differ in diameter from each other).

In the illustrated embodiment, there are two sets of jets 70 and 71. For even finer control of cooling rates that may be required for some alloys, it is possible to have more than two sets of jets, e.g. a set of jets such as jets 70 that are operated continuously, a set of jets such as jets 71 that are operated intermittently, and then a further set of jets (not shown) impacting the ingot either above jets 71 or below jets 70 and operated intermittently either at the same frequency (on/off time ratio) as jets 71 or at a different frequency. A three-chambered mold might then be required to feed the three sets of separate jets, although a two-chambered mold would be sufficient if the intermittent jets all had the same frequency. In most cases, however, two sets of jets (as shown) are sufficient.

In the illustrated embodiment, jets 70 are angled at 22.5° to the vertical and jets 71 are angled at 45°, as described. Nevertheless, the angles of either or both of these jets may be varied as desired within a range of about 30 to 105° to the vertical. Of course, any angle more than 90° would mean that the jets impact the ingot with a component of movement in the direction opposite to that of the direction of advance 67 of the ingot. This may be desired in some cases to raise the point of impact of such jets with the ingot, thereby ensuring that secondary cooling begins closer to the mold exit 15. The variation of angles can therefore be used to modify the impact points (distance from the mold) of the various jets to achieve optimal cooling effects for any mold design or metal being cast.

The application of jets 70 and 71 in the indicated manner can be carried out all around the periphery of the ingot, if desired, e.g. on both long faces (rolling faces) and both short end faces of a rectangular ingot. However, the cooling of the long faces has the greatest effect on butt curl, so the application of jets 70 and 71 in the indicated manner in the start-up stage may if desired be employed only for the long faces. The cooling of the short end faces may then be conventional using, for example, only jets 70 during the initial stage of casting. This would require a different arrangement of coolant liquid supply to the passageways for the short ends and to the long faces, which would not be preferred in many cases for reasons of economy and increased apparatus complexity.

As the casting operation proceeds beyond the initial casting stage, the valve element 48 may be lowered permanently so that jets 71, as well as jets 70, are operated continuously. Furthermore, the pressure of coolant liquid may be gradually increased (e.g. during an acceleration stage, before the steady-state casting stage, when the casting speed is also increased) so that the rate of flow of coolant liquid is increased. In the steady-state stage of casting, again both jets 70 and 71 may be operated continuously in the manner described in U.S. Pat. No. 5,582,230.

Figure 7:
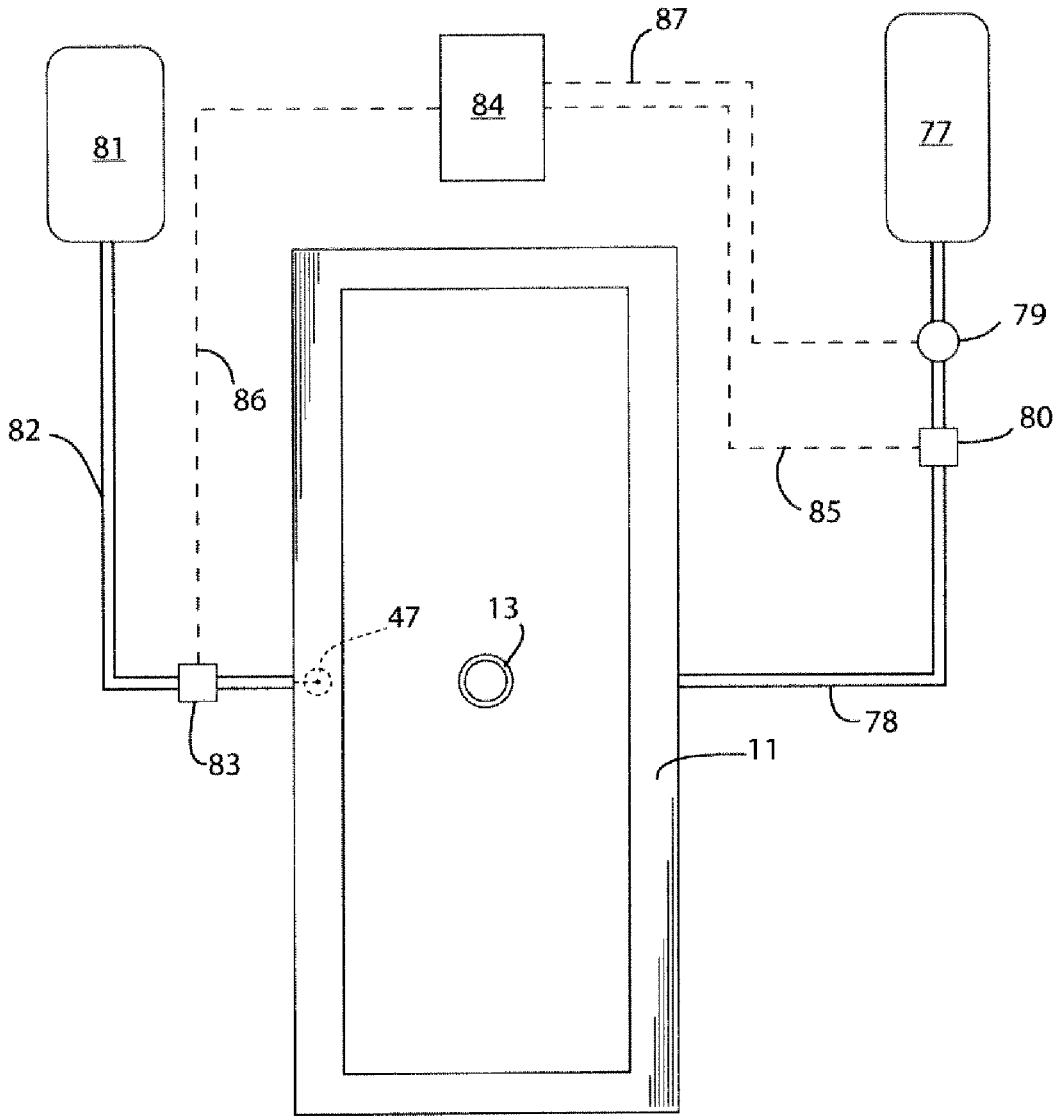
FIG. 7 is a schematic top plan view of a mold according to FIGS. 3 to 5 showing an exemplary embodiment of apparatus used to control the flow of coolant liquid and compressed air to the mold.

FIG. 7 is a schematic top plan view of a casting mold of the kind shown in FIGS. 3 to 5 illustrating apparatus for controlling the supply of coolant liquid to the mold and the operation of the valve device 47 for pulsing jets 71. Rectangular casting mold 11 is supplied with molten metal via spout 13 as previously described. Coolant liquid (water) is supplied to the upper chamber 46 of the mold (not visible in FIG. 7) from a source 77 of pressurized coolant water via a feed tube 78. The water in the tube first flows through a flow sensor 79 and then through a control valve 80 which can vary the rate of flow of coolant water to the mold. In addition, gas (normally air) under pressure is supplied from a source of compressed gas 81 to the valve device 47 via tube 82. Before flowing to the valve device 47, compressed gas in the tube 82 flows through a pressure control valve 83, that is capable of either allowing the compressed gas to flow to the valve assembly 47 or of cutting off the supply of compressed gas to the valve assembly and allowing the valve assembly 47 to vent the gas to atmosphere. Valves 80 and 83 are controlled by a programmable logic controller (PLC) 84 (or other numeric calculator) as represented by dashed lines 85 and 86, respectively. The water flow values sensed by flow sensor 79 are fed to the PLC 84 as represented by dashed line 86.

During operation, the PLC 84 modulates coolant liquid control valve 80 to vary the flow rate, as sensed by sensor 79, based on predetermined flow rates and setpoints according to the current stage of casting. In the initial stage of casting, during pulsing of jets 71 (i.e. when the jets are flowing), the flow control valve 80 is opened about 6 to 10 percentage points above a pre-pulse value, thereby roughly doubling the coolant liquid flow It rate to accommodate the flow of jets 71 as well as jets 70 without causing loss of flow rate or pressure in the continuous jets 70. Also during pulsing, an automatic control loop (which changes the valve opening command as a result of actual flow versus setpoint variances) is placed in manual mode to prevent such commands issuing from the PLC 84. Separately, the PLC controls the gas pressure to the valve assembly 47 by closing the valve 83 and venting the assembly so that valve member 48 moves to the open position under the excess pressure in the upper chamber 44 (see FIG. 3), thereby allowing coolant liquid under pressure to flow through the passageways 64 from the lower chamber 45 as well as through passageways 63 from the upper chamber 44. At the end of a pulse, the process is reversed by the PLC 84, i.e. the gas valve 83 is opened and the flow through coolant liquid valve 80 is reduced to approximately halve the flow.

Figure 8:
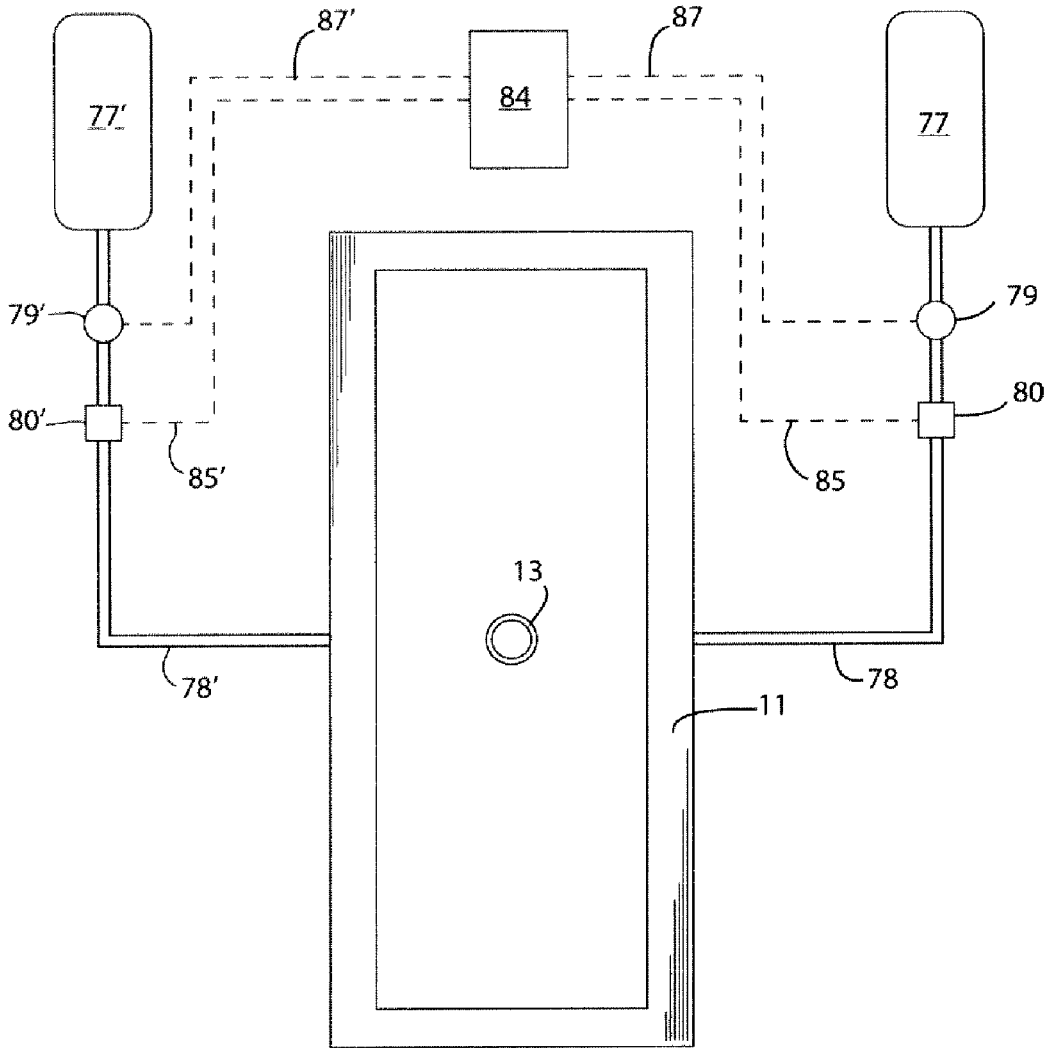
FIG. 8 is a view similar to that of FIG. 7 of an alternative exemplary embodiment.

FIG. 8 is a view similar to that of FIG. 7 but showing apparatus in which separate supplies of coolant liquid under pressure are provided for the upper chamber 44 and the lower chamber 45. In such an embodiment, there need be no communication whatsoever between the upper chamber 44 and the lower chamber 45, and therefore no need for a valve device 47. As well as providing a source of coolant liquid under pressure 77 and the associated apparatus for upper mold chamber 44 as in the case of the embodiment of FIG. 7, equivalent equipment is provided for the lower mold chamber 45, including a source of coolant liquid 77', coolant liquid supply tube 78', flow sensor 79', coolant liquid control valve 80' and connections 85' and 87' to the PLC 84. The PLC is programmed, for the initial stage of casting, to supply the upper chamber 44 with coolant liquid constantly via tube 78 and control valve 80 at a suitable rate of flow, while supplying coolant liquid intermittently to the lower mold chamber 45 by opening and closing valve 80'. This causes the jets 70 to operate constantly and the jets 71 to operate intermittently, as required.

For a more complete understanding of the exemplary embodiments, a description of a casting operation is provided in the following.

EXAMPLE

A casting operation for an aluminum ingot was carried out in apparatus of the kind illustrated in FIGS. 3 to 7 according to the following steps.

The casting operation was started as usual with only the 22.5° jets operating a low rate of flow. When the emerging ingot had reached a length of 50 mm (the ingot length at which the emerging ingot surface becomes exposed to secondary cooling between the bottom block and mold exit), a programmable logic controller (PLC) opened a valve supplying water to the 22.5° jets by 7 percentage points, which effectively doubled the water flow. Due to the speed at which the flow control valve rotated, it took a few seconds for the valve element to reach the desired position, hence it took equally as long for the water flow to reach its final value during this pulse. At the same moment that the flow control valve pulsed, the valve element was raised by the PLC, which caused water to flow through both sets of holes.

Five seconds after the valve element was pulsed open, it was commanded to return to its former position and the water flow was controlled according to the recipe. Again, it took a few seconds to reach the desired position and for the water to reach its final value during the pulse. At the same time that the water flow control valve reached the desired position, the valve element was closed, resulting in stoppage of water being fed to the 45° holes.

After a ten-second delay (a recipe parameter), the cycle was started again.

At a cast length of approximately 150 mm, water pulsing was stopped and remained off for the remainder of the cast.

What is claimed is:

1. A method of reducing butt curl during direct chill casting of a metal ingot, which method comprises:

casting a metal ingot in a direct chill casting mold in at least two casting stages including an initial casting stage carried out at a first casting speed and a steady-state casting stage carried out after said initial stage at a second casting speed higher than the first casting speed;

advancing said ingot emerging from an exit of the casting mold along a direction of ingot advance; and cooling said ingot by directing a liquid coolant onto an outer surface of the emerging ingot;

wherein, during said initial casting stage, said liquid coolant is directed onto at least a part of said outer surface in the form of at least two streams, including a constant first stream directed onto said at least part of said outer surface in the form of a series of first jets, and an intermittent second stream directed onto said at least part of said outer surface in the form of a series of second jets, wherein said first and second jets impact said at least part of said outer surface at locations of impact spaced from each other; and further wherein both said first and second streams of liquid coolant are arranged to have locations of impact and rates of flow effective to permit film boiling to take place within said streams when first in contact with said at least part of said outer surface.

2. The method of claim 1, wherein said ingot cast in said mold is generally rectangular, having two opposed longer faces and two opposed shorter ends.

3. The method of claim 2, wherein said part of said outer surface onto which said at least two streams are directed comprises only said two opposed longer faces.

4. The method of claim 2, wherein said at least two streams are directed onto all of said longer faces and shorter ends.

5. The method of claim 1, wherein said locations are spaced from each other peripherally around said ingot.

6. The method of claim 1, wherein said locations are spaced from each other in said direction of ingot advance.

7. The method of claim 6, wherein said constant stream impacts said at least part of said surface at locations further from said mold exit than said intermittent stream in said direction of ingot advance.

8. The method of claim 7, wherein said locations are spaced from each other by a distance corresponding to up to 10 diameters of said jets, or of the widest of said jets if diameters of said jets differ from each other.

9. The method of claim 6, wherein said intermittent stream impacts said at least part of said surface at locations further from said mold exit than said constant stream in said direction of ingot advance.

10. The method of claim 9, wherein said locations are spaced from each other by a distance corresponding to up to seven diameters of said jets, or of the widest of said jets if diameters of said jets differ from each other.

11. The method of claim 1, wherein jets of said series of first jets and jets of said series of second jets are provided in alternating arrangement peripherally around said ingot.

12. The method of claim 1, wherein said locations of impact fall within a region of said ingot having surface temperatures of about 200° C. or higher.

13. The method of claim 1, wherein said locations of impact fall within a region of said ingot having surface temperatures falling in a range of about 200° C. to 550° C.

14. The method of claim 1, wherein said jets have angles of impact with said at least one part of said outer surface of said ingot selected from a range of 15 to 105° relative to said direction of ingot advance.

15. The method of claim 14, wherein said jets of said first stream have angles of impact selected from a range of 15 to 30° relative to said direction of ingot advance, and said jets of said second stream have angles of selected from a range of 30 to 105° relative to said direction of ingot advance.

16. The method of claim 1, wherein said first and second streams have average rates of flow selected from a range of 0.1 to 0.5 gallons per minute per inch of mold bore.

17. The method of claim 1, wherein said intermittent second stream is caused to flow for a time period of 5 to 20 seconds, and is then caused to stop for a time period of 10 to 25 seconds, with said time periods being repeated sequentially until said initial casting stage ends.

18. The method of claim 1, wherein the intermittent second stream is caused to flow for a time period of 5 to 15 seconds, and is then caused to stop for a time period of 15 to 20 seconds, with said time periods being repeated sequentially until said initial casting stage ends.

19. The method of claim 1, wherein said coolant is first directed onto said outer surface when the emerging ingot has a length of about 50 mm from the exit of the mold in the direction of ingot advance and is terminated when the emerging ingot has a length of about 200 mm from the exit of the mold in the direction of ingot advance corresponding to an end of said initial casting stage.

20. The method of claim 1, wherein said at least two streams of said coolant are first directed onto said at least one part of the outer surface when the emerging ingot has a length of about 50 mm from the exit of the mold in the direction of ingot advance and are continued until the emerging ingot has a length of about 150 mm from the exit of the mold in the direction of ingot advance corresponding to an end of said initial casting stage.

21. The method of claim 1, wherein the jets of the first series and the jets of the second series are approximately equal in number.

22. The method of claim 1, wherein a flow of coolant liquid to said casting mold is increased when said jets of said second stream are flowing compared to when said jets of said second stream are not flowing so that a rate of flow of said jets of said first stream remains substantially unchanged regardless of whether said jets of said second stream are flowing or not.

23. The method of claim 1, wherein said intermittent second stream is controlled by generation of instructions by numeric calculator for operating at least one coolant liquid flow control device for said second series of jets.

24. The method of claim 1, wherein said first stream and said second stream have a common source of coolant liquid and are separated from each other within said mold.

25. The method of claim 1, wherein said first stream and said second stream have separate sources of coolant liquid outside said mold.

26. The method of claim 1, wherein the metal of said ingot is aluminum or an aluminum-based alloy.

27. The method of claim 1, wherein the liquid coolant is water.

28. The method of claim 1, wherein said mold is operated to produce said ingot as a monolithic ingot.

29. The method of claim 1, wherein said mold is operated to produce said ingot as a composite ingot.

30. The method of claim 1, wherein at least two constant streams of said coolant liquid are directed onto said outer surface of the ingot during said steady state casting stage, at least one of said constant coolant streams having a higher rate of flow than each of said constant first stream and said intermittent second stream of said initial casting stage.

31. The method of claim 1, wherein at least two constant streams of said coolant liquid are directed onto said outer surface of the ingot during said steady state casting stage, both or all of said at least two constant coolant streams having a higher rate of flow than each of said constant first stream and said intermittent second stream of said initial casting stage.

32. The method of claim 1, wherein said initial casting stage and said steady state casting stage are separated in time by an acceleration casting stage in which the speed of advance of the ingot is increased in rate from said first casting speed to said second casting speed.

33. The method of claim 32, wherein at least two constant streams of said liquid coolant are directed to said outer surface of the ingot during said acceleration casting stage and at least one of said two streams is increased in rate of flow as said acceleration casting stage proceeds.

34. The method of claim 33, wherein both or all of said at least two constant streams of said liquid coolant are increased in rate of flow as said acceleration casting stage proceeds.

* * * * *